US006611247B1

(12) United States Patent
Chang et al.

(10) Patent No.: US 6,611,247 B1
(45) Date of Patent: Aug. 26, 2003

(54) DATA TRANSFER SYSTEM AND METHOD FOR MULTI-LEVEL SIGNAL OF MATRIX DISPLAY

(75) Inventors: Jung-Chung Chang, Tainan County (TW); Yen-Chen Chen, Tainan County (TW)

(73) Assignee: Himax Technologies, Inc., Tainan Hsien (TW)

( * ) Notice: Subject to any disclaimer, the term of this patent is extended or adjusted under 35 U.S.C. 154(b) by 0 days.

(21) Appl. No.: 09/345,962

(22) Filed: Jul. 1, 1999

(51) Int. Cl.[7] ..... G09G 3/36; G09G 5/00

(52) U.S. Cl. ..... 345/99; 345/100; 345/212; 345/213; 345/214

(58) Field of Search ..... 345/98–100, 211–214

(56) References Cited

U.S. PATENT DOCUMENTS 4,872,002 A * 10/1989 Stewart et al. ..... 345/211
5,900,857 A * 5/1999 Kuwata ..... 345/100
5,923,342 A * 7/1999 Greenwood et al. ..... 345/520
5,953,002 A * 9/1999 Hirai et al. ..... 345/204
5,974,464 A * 10/1999 Shin et al. ..... 709/231
6,144,355 A * 11/2000 Murata et al. ..... 345/99
6,246,398 B1 * 6/2001 Koo ..... 345/204

* cited by examiner

*Primary Examiner*—Richard Hjerpe
*Assistant Examiner*—Duc Q Dinh
(74) *Attorney, Agent, or Firm*—Rabin & Berdo, P.C.

(57) ABSTRACT

The present invention discloses a data transfer system and method for a matrix display. The system includes a multi-level timing controller connected to a multi-level input data driver via a multi-level signal bus. A digital input signal necessary for image display is converted into a multi-level signal display data output by an encoder in the multi-level timing controller, transferred to the multi-level input data driver through the multi-level signal bus, and converted into a data driving signal for a display panel by a decoder. According to the present invention, due to the multiple levels, the number of lines between the controller and the data driver can be considerably decreased and data transfer frequency is reduced.

10 Claims, 9 Drawing Sheets

$M=N/\log_2 L$

M : required wire number for multi-level data transfer
N : bit number of input signal RGB data
L : level number of multi-level encoder/decoder

DATA TRANSFER SYSTEM AND METHOD FOR MULTI-LEVEL SIGNAL OF MATRIX DISPLAY

FIELD OF THE INVENTION

The present invention relates to a matrix display system, and more particularly, to a display data transfer system and method for a matrix display in which multi-level signaling is used for transferring display data needed for image display on a display panel.

Hereinafter, the description is made with reference to a liquid crystal display (LCD). However, other display devices such as electro-luminescence (EL) display, plasma display panel (PDP) or the likes are also suitable for the present invention.

BACKGROUND OF THE INVENTION

In consideration of size, weight, power and so on, thin or flat displays have been developed, including liquid crystal displays, electro-luminescence displays and electro chromic (EC) displays. Generally, such a display comprises a plurality of picture element circuits arranged as a matrix. Each of the picture element circuits is controlled to turn on/off to determine display state of its corresponding pixel.

FIG. 1 is a block diagram showing a conventional active matrix LCD. A LCD panel 100 comprises a plurality of data bus lines X1, X2, . . . , Xm, a plurality of scan bus lines Y1, Y2, . . . , Yn, and a plurality of pixels disposed between the data bus lines and scan bus lines. Each of the pixels consists of a liquid crystal cell and a switching element. In this case, the switching element is a thin film transistor (TFT). The TFT is connected between the liquid crystal cell and one of the data bus lines, and it has a gate connected to one of the scan bus lines. A scan driver 10 selects one of the TFTs in a LCD panel 100 and a digital input data driver 20 provides a data driving signal. A voltage signal required by the scan driver 10 and the digital input data driver 20 is provided by a DC-DC and γ voltage generator 30. A display data required for image display is generated by a digital timing controller 40 through an input interface 50, and is sent to the digital input data driver 20 via a digital bus 60.

To achieve higher speed and better performance, it is proposed that only digital signals are used for data driving. However, in a color LCD, R (red), G (green) and B (blue) video signals can be deemed as three parallel data bus signals, and each of the R, G and B color signals has g bits, which determines a resolution of luminescence for a respective color. Therefore, the display data signals can be considered to be carried by a bus consisting of 3×g data lines. As space resolution and luminescence resolution of an image are increased, number of the data lines (i.e., width of the digital bus 60) is remarkably increased. Relation between bit number of a color LCD and wiring number is shown in Table 1.

TABLE 1

| Input Port Number of Data Driver | Bit Number | Wring Number |
|---|---|---|
| 1 | 6 | 18 |
| | 8 | 24 |
| 2 | 6 | 36 |
| | 8 | 48 |

On the other hand, as transfer speed of interface signal or operating speed of system is increased, transfer frequency of the digital bus 60 is enhanced. Transfer frequencies for various resolutions are shown in Table 2.

TABLE 2

| Input Port Number of Data Driver | Resolution | Transfer Frequency (MHz) |
|---|---|---|
| 1 | VGA | 25.175 |
| | SVGA | 40 |
| | XGA | 65 |
| 2 | VGA | 12.5875 |
| | SVGA | 20 |
| | XGA | 32.5 |

The increased transfer frequency causes a large electromagnetic interference (EMI). The increased width of the digital but 60 not only increases the wiring number, which in turn makes the circuitry complicated and layout of printed circuit board difficult, but also deteriorates the EMI problem.

For example, in a 6-bit XGA notebook computer, data transfer system of the LCD is shown in FIG. 2. An input interface 50 utilizes a transceiver for low voltage differential signal (LVDS). The transceiver receives a digital input signal and then outputs it to a digital timing controller 40 where it is converted into a digital display data signal and sent to a digital input data driver 20. Digital data bus lines between the digital timing controller 40 and digital input data driver 20 only carry signals of either logic "0" or "1". An input terminal of the input interface 50 is connected to a single-port, 65 MHz bus with 18 bit lines. A buffer can be used in the input interface 50 to produce a two-port output to halve the transfer frequency (32.5 MHz), but the bus width is doubled to have 36 data lines, and transfer between the digital timing controller 40 and the digital input data driver 20 is at 32.5 MHz with two ports. In other words, a compromise must be reached between the bus width and the transfer frequency.

SUMMARY OF THE INVENTION

Therefore, an object of the present invention is to set forth a data transfer system and method for a matrix type display in which data bus lines are decreased, thereby reducing connection wiring between a timing generator and a data driver, and improving circuitry of the display and layout of printed circuit board.

Another object of the present invention is to reduce data transfer frequency of a matrix type display to resolve the EMI problem.

To achieve the above objects, according to the present invention, a data transfer system for a matrix type display includes a multi-level timing controller connected to a multi-level input data driver via a multi-level signal bus. A digital input signal necessary for image display is converted into a multi-level signal display data output by an encoder in the multi-level timing controller, transferred to the multi-level input data driver through the multi-level signal bus, and converted into a data driving signal for a display panel.

In the timing controller, a display data is converted from a digital format into a multi-level format before entering the bus. After the display data passes through the bus, it is converted back into the original digital format in the data driver. By the aid of the multi-level signal, each bus line between the timing controller and the data driver can carry a multi-state data signal. That is, level number of bus signal states is increased, thereby remarkably decreasing wiring between the controller and the data driver and reducing data transfer frequency at the same time.

These and other objects, features and advantages of the present invention will become apparent to those skilled in the art upon consideration of the following description of the preferred embodiments of the present invention taken in conjunction with the accompanying drawings.

DETAILED DESCRIPTION

Figure 5:
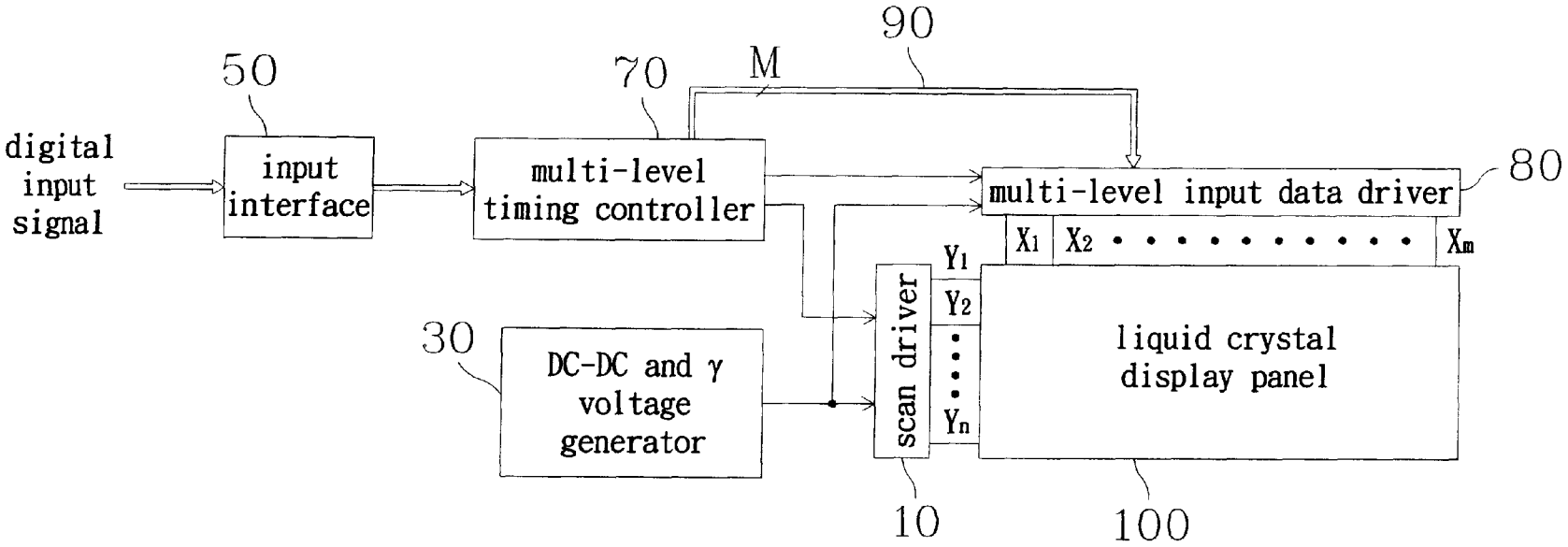
FIG. 5 is a block diagram of an active matrix LCD according to the present invention.

According to the present invention, a multi-level signaling is used in a data transfer system of a matrix display, thereby reducing data bus wiring and data transfer frequency. FIG. 5 is a block diagram of an active matrix LCD according to the present invention. Like the prior art, a LCD panel 100 comprises a plurality of data bus lines X1, X2, . . . , Xm, a plurality of scan bus lines Y1, Y2, . . . , Yn, and a plurality of pixels disposed between the data bus lines and scan bus lines. Each of the pixels consists of a liquid crystal cell and a TFT. The TFT has a source connected to one of the data bus lines and a gate connected to one of the scan bus lines.

A data transfer system comprises a multi-level timing controller 70 and a multi-level input data driver 80 connected through a multi-level signal bus 90. A digital input signal is converted into an output by an input interface 50 and sent to the multi-level timing controller 70. Then it is converted by the controller 70 into a multi-level display data output, which is sent to the multi-level input data driver 80 through the multi-level signal bus 90, and then converted into a data driving signal for a LCD panel 100. Each data line in the multi-level signal bus 90 carries a signal with one of L levels. In other words, the multi-level timing controller 70 converts a digital signal of either logic "0" or "1" into a multi-level (L-level) signal.

Since each of the data lines in the multi-level signal bus 90 correspond to L levels, width of the multi-level signal bus 90 can be remarkably decreased. Ratio of the width to the conventional width is $R=1/\log_2 L$.

Figure 6:
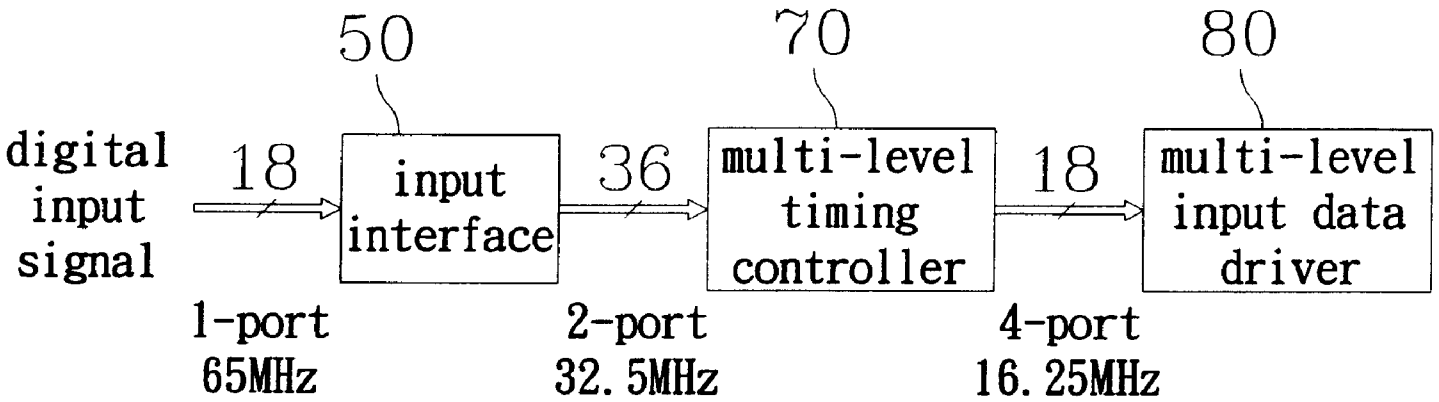
FIG. 6 is a schematic view of a data transfer system of a LCD for a notebook computer with a 6-bit XGA according to the present invention.

For example, FIG. 6 shows a data transfer system of the present invention used in a notebook computer with a 6-bit XGA. An input terminal of an input interface 50 is connected to a single-port, 65 MHz bus with 18 bit lines. A buffer can be used in the input interface 50 to produce a two-port output to halve the transfer frequency (32.5 MHz) and the bus width is doubled (36 data lines). However, multi-level bus having 8 levels is used between a multi-level timing controller 70 and a multi-level input data driver 80, and thus the bus width is halved (18 data lines) and the transfer frequency is halved (16.25 MHz) too. In other words, the bus width and the transfer frequency are reduced at the same time.

Figure 1:
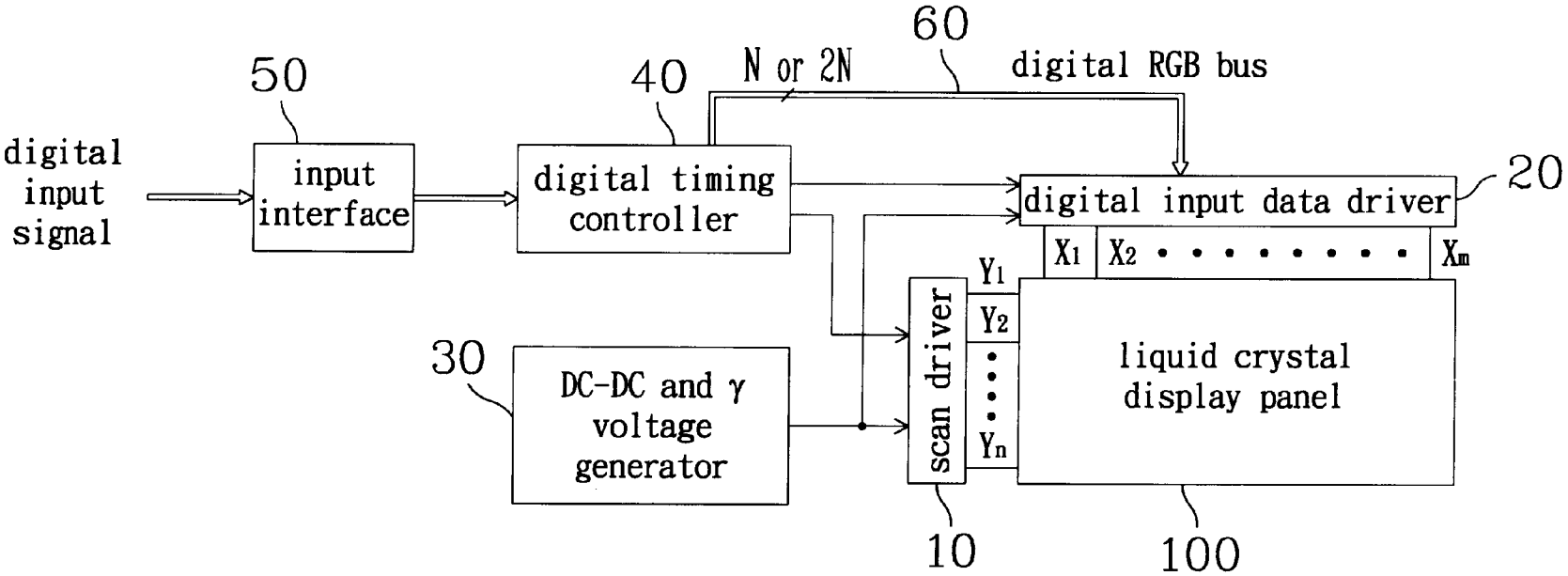
FIG. 1 is a block diagram of a conventional active matrix LCD.
Figure 2:
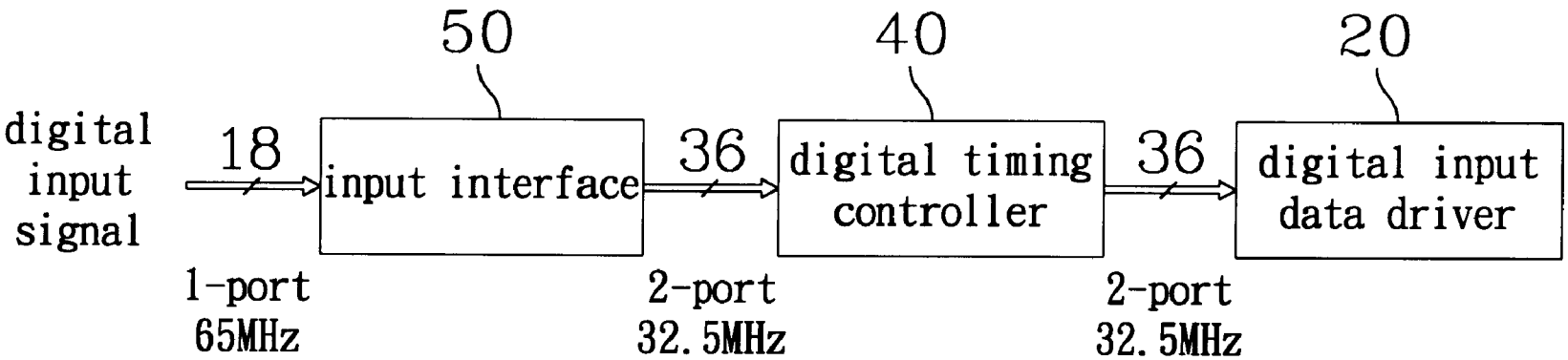
FIG. 2 is a schematic view of a conventional data transfer system of a LCD for a notebook computer with a 6-bit XGA.
Figure 3:
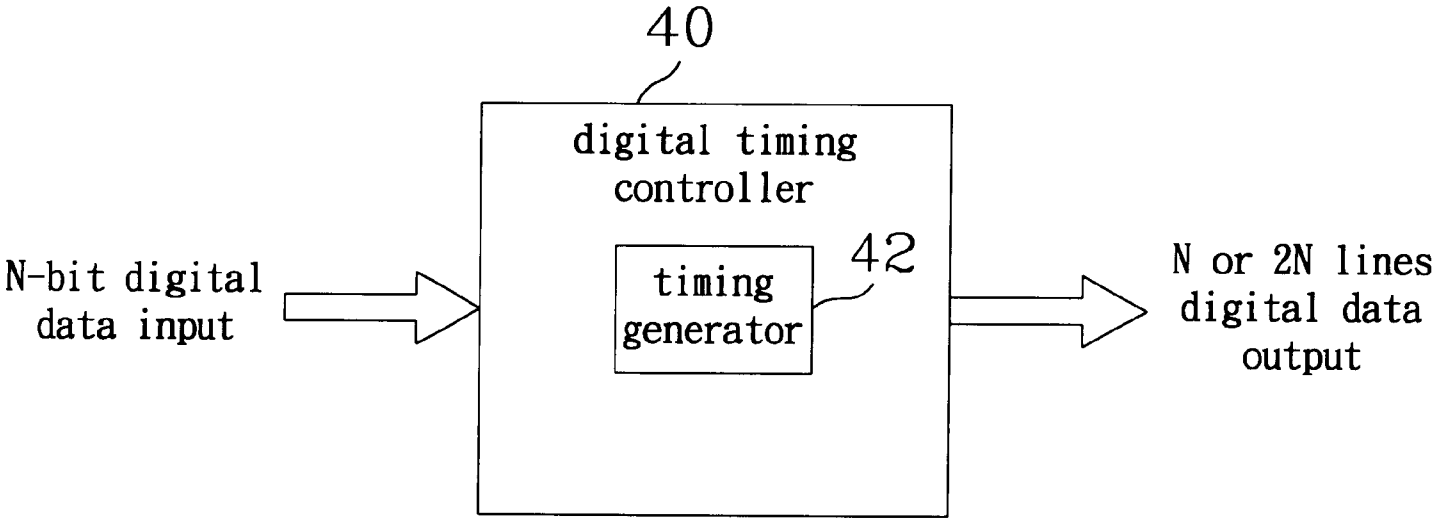
FIG. 3 is a schematic view of a conventional digital timing controller of a LCD.
Figure 4:
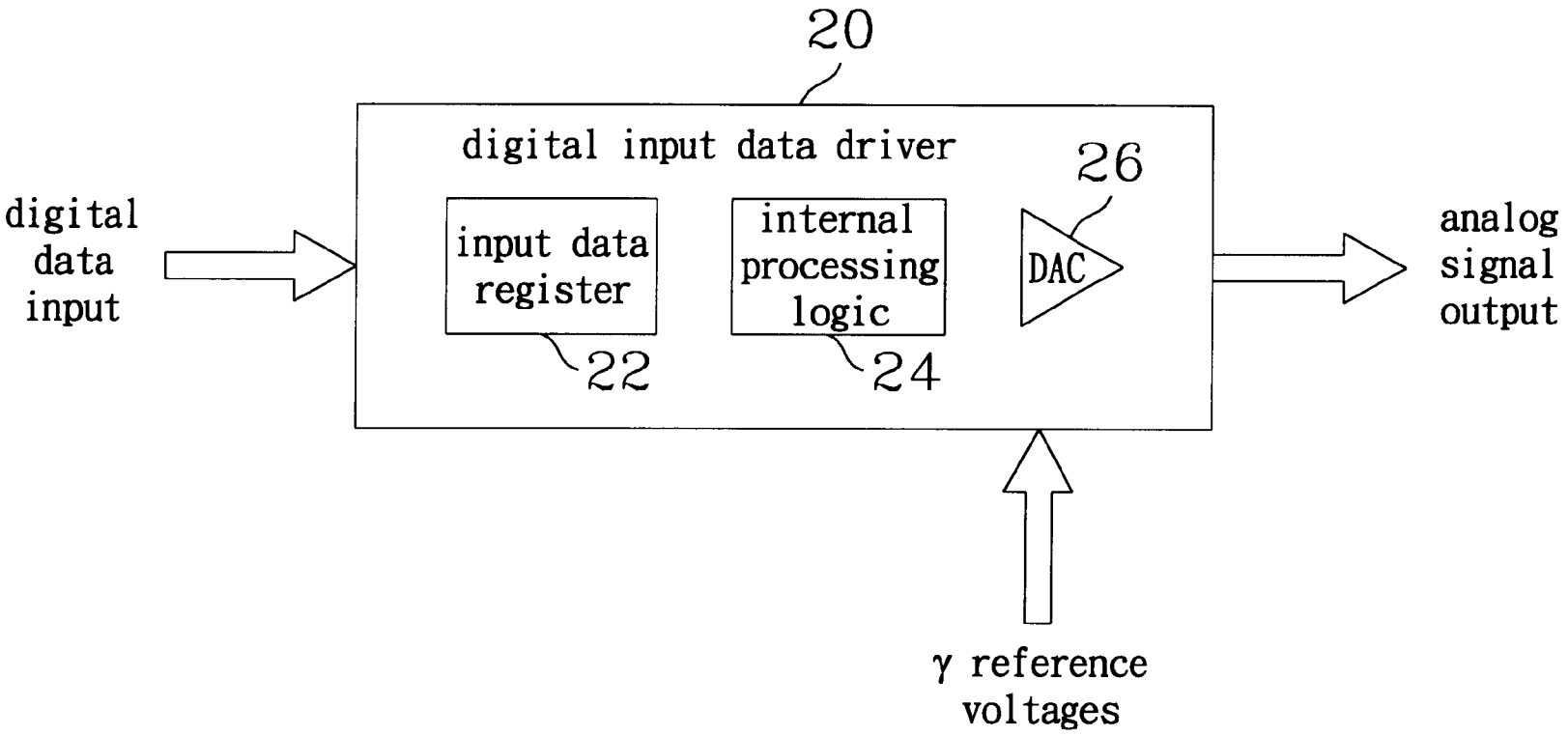
FIG. 4 is a schematic view of a conventional digital input data driver of a LCD.
Figure 7:
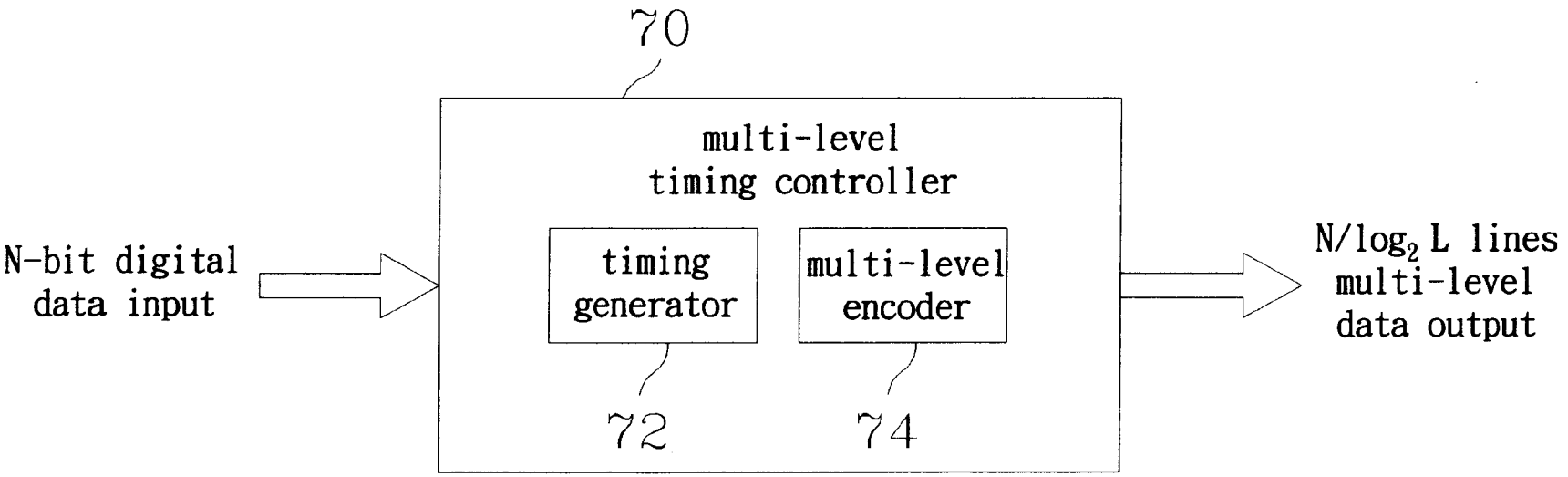
FIG. 7 is a schematic view of a multi-level timing controller according to the present invention.
Figure 8:
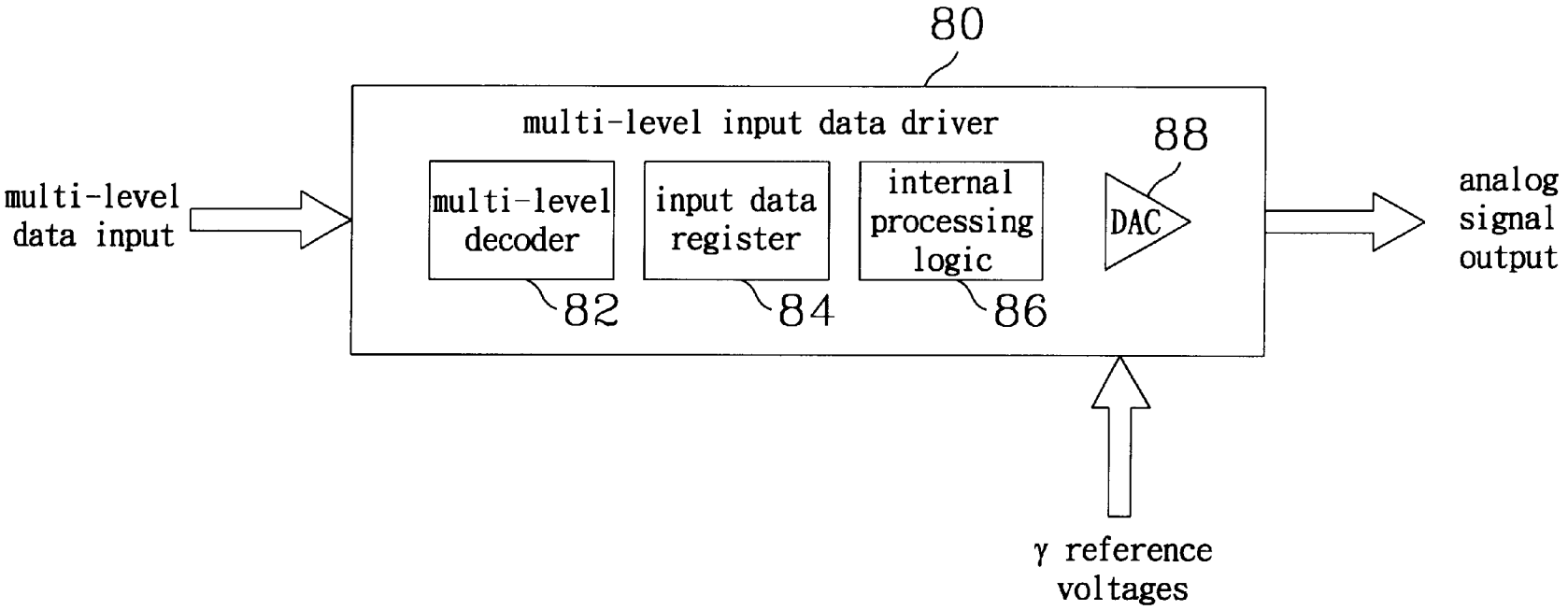
FIG. 8 is a schematic view of a multi-level input data driver according to the present invention.

In comparison with the inventive data transfer system and the prior art system, timing controllers thereof are shown in FIGS. 3 and 7 respectively, and data drivers thereof are shown in FIGS. 4 and 8 respectively.

As shown in FIG. 3, according to the prior art, a digital timing controller 40 comprises a timing generator 42 for generating N or 2N digital data outputs based on a N-bit digital data input. According to the present invention, as shown in FIG. 7, in addition to a timing generator 72, a multi-level timing controller 70 further comprises a multi-level encoder 74 in which an N-bit digital data input is encoded into a multi-level (L-level) data output by the multi-level encoder 74, and $N/\log_2 L$ data lines are needed for output.

On the other hand, in a prior art digital input data driver 20 shown in FIG. 4, data from FIG. 3 passes through an input data register 22, an internal processing logic 24 and a digital-to-analog converter (DAC) to become an analog signal output, which is a data driving signal. According to the present invention, as shown in FIG. 8, the multi-level data from FIG. 7 is inputted to a multi-level input data driver 80 and then is decoded by a multi-level decoder 82. After that, it passes through an input data register 84, an internal processing logic 86 and a DAC 88 to become an analog signal output for a LCD panel 100.

Figure 9:
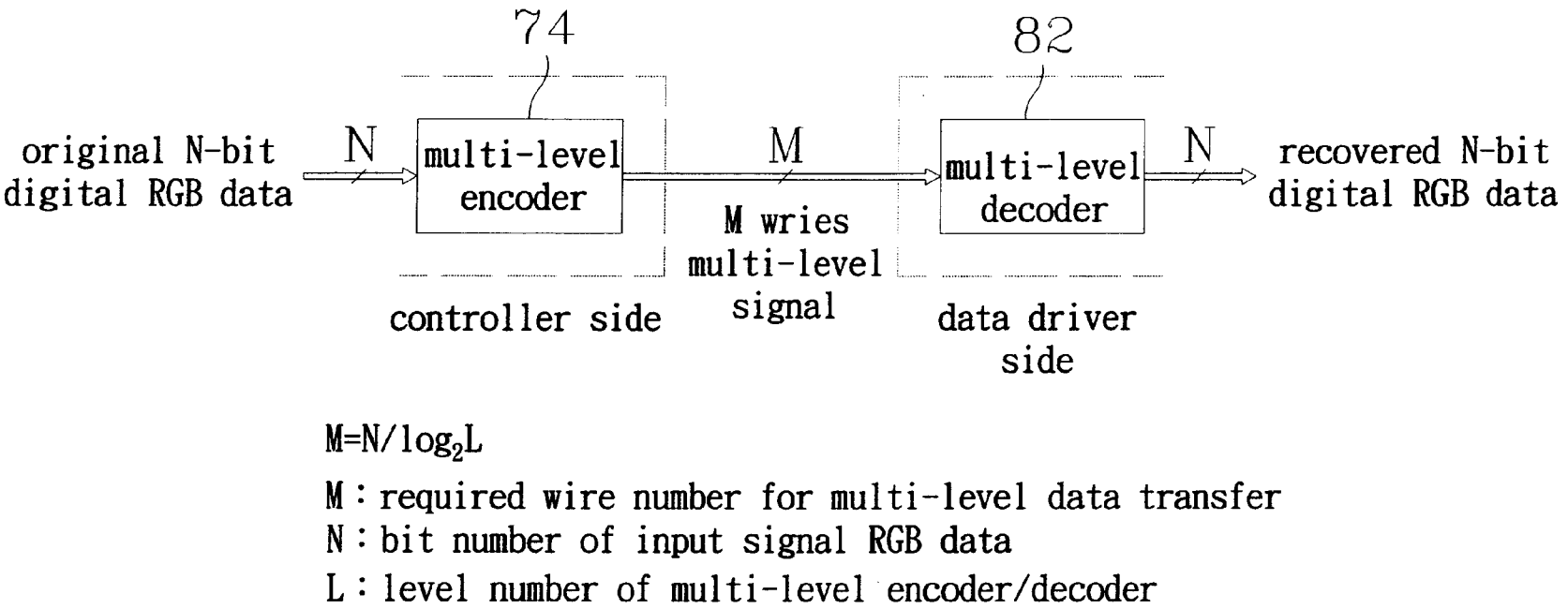
FIG. 9 is a schematic view of a multi-level data bus wiring according to the present invention.

FIG. 9 is a schematic view of a data bus wiring according to the present invention. On a printed circuit board, an input of the multi-level encoder 74 at controller side is an N-bit digital RGB signal and is encoded into a multi-level (L-level) signal. The resulting output is transferred through a bus having M lines, and is decoded into the N-bit digital RGB signal by the multi-level decoder 82.

$$M=N/\log_2 L$$

where M is line number needed for transferring the multi-level data, N is bit number of the input digital RGB data, and L is level number of the multi-level encoder and decoder. The lines between the controller and the data driver is decreased by $$\Delta=N-M=N(1-1/\log_2 L).$$

Various conditions showing comparison between the present invention and the prior art with respect to RGB data transfer between the LCD controller and the data driver are provided in Table 3.

TABLE 3

| Input Pixel Every Clock | Bit Number of Data Driver | Prior Art Wiring | Inventive Level Number | Inventive Wiring 1 pixel every clock | Inventive Wiring 2 pixels every clock |
|---|---|---|---|---|---|
| 1 | 6 | 18 | 8 | 6 | 12 |
| | | | 64 | 3 | 6 |
| | 8 | 24 | 16 | 6 | 12 |
| | | | 256 | 3 | 6 |
| 2 | 6 | 36 | 8 | — | 12 |
| | | | 64 | — | 6 |
| | 8 | 48 | 16 | — | 12 |
| | | | 256 | — | 6 |

When the data input and output speeds of the timing controller are the same and equals to 1 pixel/clock, $N(1-1/\log_2 L)$ bus lines can be saved. When the data input speed of the timing controller is 1 pixel/clock and the output speed is 2 pixels/clock, $N(1-1/\log_2 L)/2$ bus lines can be saved. Further, more lines are saved as bit number for each color is increased.

Comparison between the present invention and the prior art with respect to operation frequency for RGB data transfer between the LCD controller and the data driver is provided in Table 4.

TABLE 4

| Input Pixel Every Clock | Resolution | Prior Art Operation Freq. (MHz) | Inventive Operation Freq. (MHz) 1 pixel every clock | Inventive Operation Freq. (MHz) 2 pixels every clock | Inventive Operation Freq. (MHz) 4 pixels every clock |
|---|---|---|---|---|---|
| 1 | VGA | 25.175 | 25.175 | 12.5875 | 6.29375 |
| | SVGA | 40 | 40 | 20 | 10 |
| | XGA | 65 | 65 | 32.5 | 16.25 |
| 2 | VGA | 12.5875 | — | 12.5875 | 6.29375 |
| | SVGA | 20 | — | 20 | 10 |
| | XGA | 32.5 | — | 32.5 | 16.25 |

When the data input speed of the timing controller is 1 pixel/clock and the output speed is 2 pixels/clock, the operation frequency can be halved according to the present invention. When the data input speed of the timing controller is 1 pixel/clock and the output speed is 4 pixels/clock, the operation frequency can be one quarter of the prior art frequency.

In conclusion, the present invention utilizes multi-signaling for transferring a display data for a matrix display in which a multi-level bus is provided. Each data line of the bus can be in one of multiple states. An encoder and a decoder are provided at both ends of the bus (i.e., the timing controller and the data driver) to convert the digital display data into a multi-level signal and vice versa, thereby reducing the bus width and the transfer frequency, and solving the problems of bus wiring and EMI.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A data transfer system for a multi-level signal for providing a display data to a matrix display panel, comprising:

a multi-level timing controller for receiving a digital data input and converting it into a multi-level signal display data output;

a multi-level signal bus having a plurality of data lines, connected to said multi-level timing controller, for transferring said multi-level signal display data from said multi-level timing controller; and a multi-level input data driver connected to said multi-level signal bus, for receiving said multi-level signal display data input and converting it into a data driving signal to be outputted to said matrix display panel.

2. The system according to claim 1, wherein said multi-level timing controller comprises a multi-level encoder for encoding said digital data input and said multi-level input data driver comprises a multi-level decoder for decoding said multi-level signal display data.

3. A data transfer method for a multi-level signal for providing a display data to a matrix display panel, said method comprising the steps of:

(a) converting a first digital data signal into a multi-level signal display data output by a multi-level timing controller;

(b) transferring said multi-level signal display data by a multi-level signal bus comprising a plurality of data lines; and (c) converting said multi-level signal display data input into a second digital data signal by a multi-level input data driver.

4. The method according to claim 3, further comprising converting said second digital data signal into an analog signal.

5. The method according to claim 3, wherein step (a) comprises encoding said first digital data signal by a multi-level encoder, and step (c) comprises decoding said multi-level signal display data by a multi-level decoder.

6. A liquid crystal display device, comprising:

a matrix liquid crystal display panel;

a scan driver for providing a scan voltage signal to said liquid crystal display panel by a plurality of scan bus lines; and a display data transfer system for providing a data driving signal to said liquid crystal display panel by a plurality of data bus lines, said display data transfer system comprising:

a multi-level timing controller for receiving a digital data input and converting it into a multi-level signal display data output;

a multi-level signal bus having a plurality of data lines, connected to said multi-level timing controller, for transferring said multi-level signal display data from said multi-level timing controller; and a multi-level input data driver connected to said multi-level signal bus, for receiving said multi-level signal display data input and converting it into said data driving signal.

7. The device according to claim 6, wherein said multi-level timing controller comprises a multi-level encoder for encoding said digital data input and said multi-level input data driver comprises a multi-level decoder for decoding said multi-level signal display data.

8. The system according to claim 1, wherein said multi-level signal display data is in the form of digital signals with amplitudes equal to one of eight values.

9. The method according to claim 3, wherein said multi-level signal display data is in the form of digital signals with amplitudes equal to one of eight values.

10. The device according to claim 6, wherein said multi-level signal display data is in the form of digital signals with amplitudes equal to one of eight values.

* * * * *